United States Patent [19]

Knisely

[11] Patent Number: 4,585,038

[45] Date of Patent: Apr. 29, 1986

[54] AUXILIARY BLOW NOZZLE FOR A PNEUMATIC WEAVING MACHINE

[75] Inventor: Charles Knisely, Karlsruhe, Fed. Rep. of Germany

[73] Assignee: Sulzer Brothers Limited, Winterthur, Switzerland

[21] Appl. No.: 677,863

[22] Filed: Dec. 4, 1984

[30] Foreign Application Priority Data

Dec. 9, 1983 [EP] European Pat. Off. ..... 83810580.7

[51] Int. Cl.[4] ..... D03D 47/28

[52] U.S. Cl. ..... 139/435

[58] Field of Search ..... 139/435; 226/97

[56] References Cited

U.S. PATENT DOCUMENTS

| | | | |
|---|---|---|---|
| 4,372,348 | 2/1983 | Gunneman | 139/435 |
| 4,442,871 | 4/1984 | Suzuki et al. | 139/435 |

FOREIGN PATENT DOCUMENTS

| | | | |
|---|---|---|---|
| 0053216 | 6/1982 | European Pat. Off. | 139/435 |
| 2740108 | 3/1978 | Fed. Rep. of Germany | 139/435 |
| 3204363 | 8/1983 | Fed. Rep. of Germany | 139/435 |

*Primary Examiner*—Henry S. Jaudon

*Attorney, Agent, or Firm*—Kenyon and Kenyon

[57] ABSTRACT

The auxiliary blow nozzle for a pneumatic weaving machine has an inlet duct and an exit port bent relative thereto. The end zone of the inlet duct adjacent the exit port contains at least one rib extending parallel to the inlet duct longitudinal direction.

14 Claims, 5 Drawing Figures

AUXILIARY BLOW NOZZLE FOR A PNEUMATIC WEAVING MACHINE

This invention relates to an auxiliary blow nozzle for a pneumatic weaving machine.

As is known, various types of auxiliary blow nozzles have been used for propelling a weft thread through a shed in a weaving machine. For example, as described in French Pat. No. 2475586, one known auxiliary blow nozzle is formed with an inlet duct and an exit port which is disposed at an angle to the inlet duct. During operation, air flows through the inlet duct in a vertically upward direction and is then deflected in a horizontally inclined direction to give an inclined blast from the exit port into a weft guide channel in the weaving shed. However, one disadvantage of this type of nozzle is that the deflection of air results in a swirl in which the individual flow elements are subject to centrifugal force. Thus, when the air blast emerges from the nozzle, the air stream is eddied and torn apart cyclone-fashion.

Accordingly, it is an object of the invention to provide an improved auxiliary blow nozzle for transporting a weft thread through a shed.

It is another object of the invention to ensure the formation of a coherent air jet with a minimum dispersion angle from an auxiliary blow nozzle in a pneumatic weaving machine.

Briefly, the invention provides an auxiliary blow nozzle for a pneumatic weaving machine which has an inlet duct for conveying a flow of air longitudinally thereof, an exit port disposed at an end zone of the inlet duct and at an angle to the inlet duct and at least one rib which extends parallel to the inlet duct in the end zone and adjacent to the exit port. The provision of the rib makes it possible to effectively prevent any swirl from forming during deflection of the air from the inlet duct to the exit port so that the exit air jet consists of practically co-directional sub-flows having an optimum directional effect. This, in turn, gives a maximum thrust for the transport of a weft thread as well as an induction effect.

In one very advantageous embodiment, the rib may extend substantially as far as the opposite wall of the inlet duct. This provides optimum swirl prevention and directional effect with relatively simple production.

Further, the base of the inlet duct adjacent the rib may be inclined to the central longitudinal plane of the rib. This provides an additional inclination or bend of the exit flow.

The end zone of the inlet duct surrounding the rib may have two part-ducts of different cross sections in order to provide a more favorable control of the jet angle.

The flanks of the rib may also be inclined at different angles to the longitudinal central plane of the rib so that the guide length effect of the rib relative to the exit duct and, hence, the directional effect are improved.

In order to reduce the dispersion of the exit jet, the length of the exit port may be made larger than the radius of the port.

In order to enhance the directional effect, the edge of the exit port adjacent to the rib may be rounded. This increases the effective cross-section and effective guide length of the exit port.

The end zone of the inlet duct may also have a substantially triangular bevel which tapers toward the exit port. This provides additional optimization of the flow conditions towards the exit port.

These and other objects and advantages of the invention will become more apparent from the following detailed description taken in conjunction with the accompanying drawings wherein.

Figure 1:
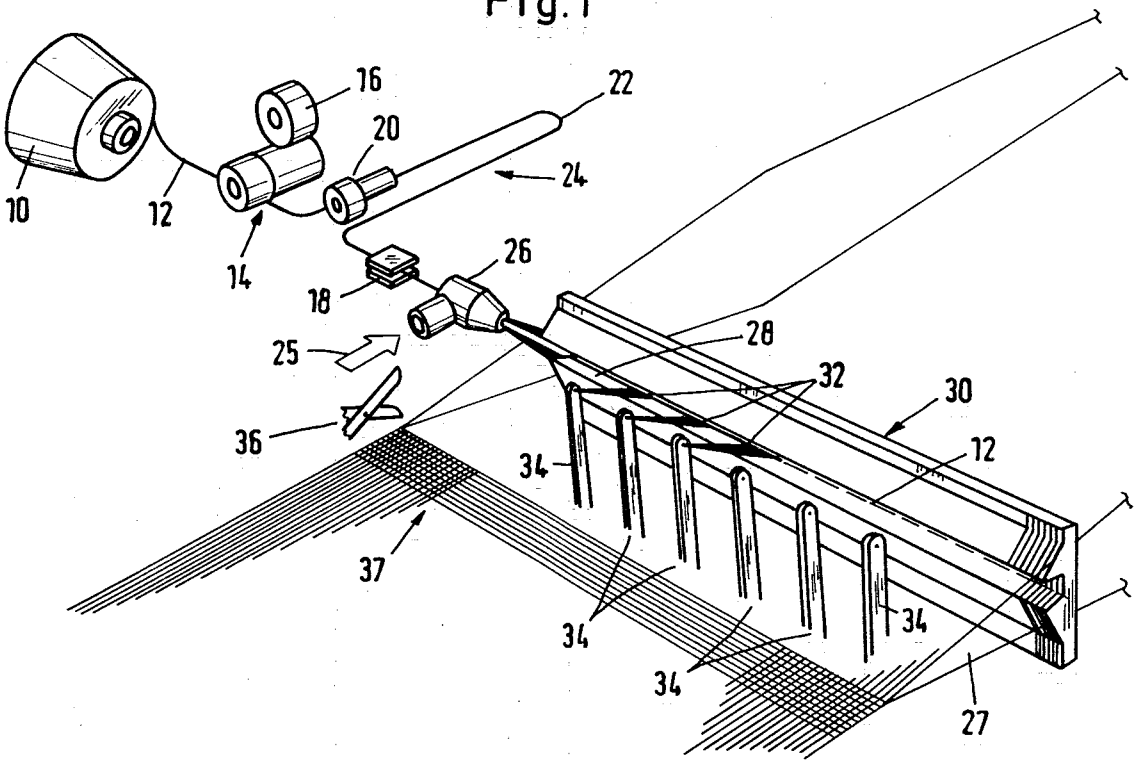
FIG. 1 illustrates a diagramatic view of a weaving machine employing auxiliary blow nozzles in accordance with the invention.

Referring to FIG. 1, only those parts of a pneumatic weaving machine are shown which are necessary for an understanding of the positioning of a row of auxiliary blow nozzles within the weaving machine. As indicated, a supply bobbin 10 is provided to deliver a weft thread 12 to driver rollers 14 which, in turn, deliver the thread 12 at a constant speed. The thread length per pick is determined, according to the fabric width, by the size and speed of rotation of a metering disc 16 adjacent the driver rollers 14 in known manner. In addition, with a thread brake 18 closed, the weft thread 12 is held in readiness for picking in the form of a loop 22 in a blown thread storage means 24 by means of an air flow from an auxiliary nozzle 20. A main nozzle 26 having an air supply which is indicated by the arrow 25, is located downstream of the thread brake 18. Immediately before the yarn brake 18 opens, the main nozzle 26 starts to blow so that weft thread 12 moves on opening of the brake 18. Under these conditions, with shed 27 open, the thread loop 22 is used up and the weft thread 12 is blown into the guide channel 28 of the reed 30.

As shown in FIG. 1, a row of auxiliary blow nozzles 34 are located in series within the shed so that outgoing air flows 32 from the nozzles 34 carry the weft thread 12 through the shed 27.

At the end of each picking cycle, the thread brake 18 closes. The stretched weft thread 12 is then beaten up into the finished fabric 37 and is cut by a cutter 36 after closing of the shed.

Figure 2:
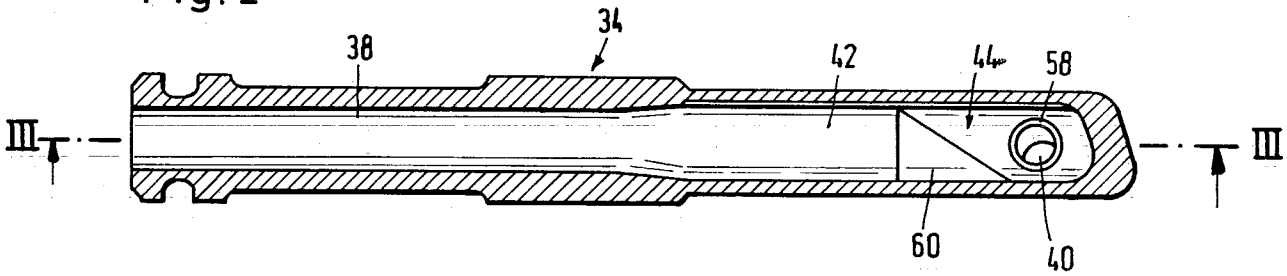
FIG. 2 illustrates a longitudinal sectional view through an auxiliary blow nozzle constructed in accordance with the invention.
Figure 3:
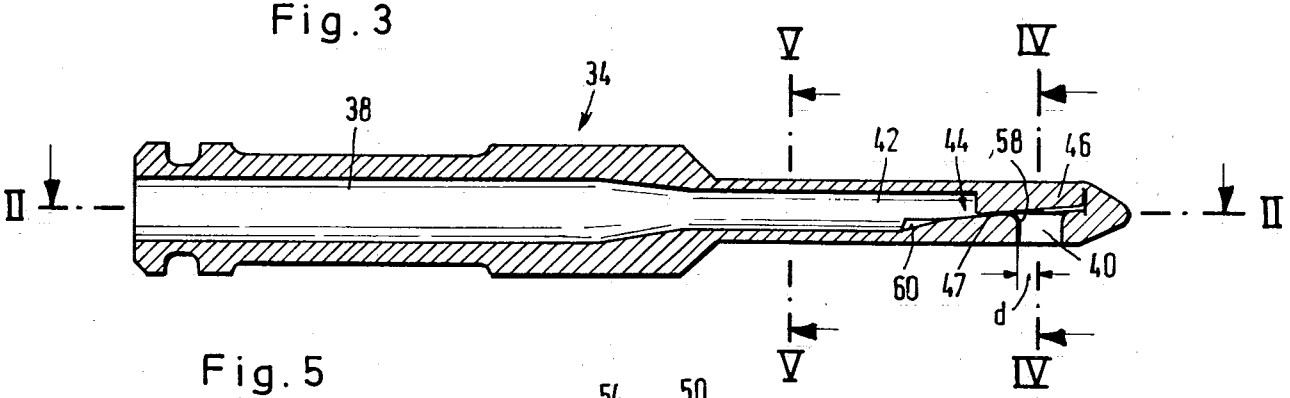
FIG. 3 illustrates a view taken on line III—III of FIG. 2.
Figure 4:
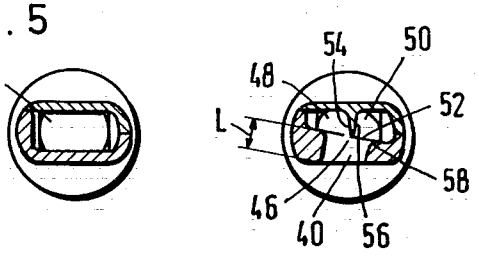
FIG. 4 illustrates a view taken on line IV—IV of FIG. 2.
Figure 5:
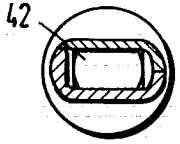
FIG. 5 illustrates a view taken on line V—V of FIG. 2.

Referring to FIG. 2, each auxiliary blow nozzle 34 comprises an elongated body which is to be disposed in a vertical plane. As indicated, an inlet duct 38 is formed within the body 4 conveying a flow of air along the longitudinal axis of the body. Further, the duct 38 is formed with a constriction 42 immediately upstream of an end zone 44. In addition, an exit port 40 is formed in the body to communicate with the end zone 44 of the inlet duct 38 in order to exhaust a coherent air jet therefrom. As indicated, the exhaust port 40 is disposed on an axis which is angularly disposed to the longitudinal axis of the elongated body. Referring to FIGS. 3 and 4, a flat elongated rib 46 is disposed on the body of the nozzle within the end zone 44 of the inlet duct 38 and opposite the exit port 40. As indicated, this rib 46 extends parallel to the longitudinal axis of the elongated body and runs substantially as far as the opposite wall 47 of the inlet duct 38. The rib 46 is sized and disposed so as to divide the end zone 44 into a pair of part-ducts 48, 50 of different cross-sectional shape from each other.

Referring to FIG. 4, the inlet duct 38 has a base 52 in the end zone 44 opposite the rib 46 which is disposed in a plane inclined to the central longitudinal plane of the rib 46. In addition, the rib 46 has a pair of flanks 54, 56 each of which is inclined to the central longitudinal plane of the rib 46 at an angle different from the other flank. For example, one flank 54 may be parallel to the longitudinal central plane while the other flank 56 is at an angle of about 15° to 30°.

As indicated in FIGS. 3 and 4, the exit port 40 extends from the base 52 of the inlet duct 38 and has a circular opening of a given radius d. Further, as indicated in FIG. 4, the exit port 40 has a maximum length L greater than the radius d of the circular opening. Further, the edge 58 of the outlet port 40 nearest the rib 46 is rounded.

Referring to FIGS. 1 and 2, the end zone 44 of the inlet duct 38 is provided with a substantially triangular bevel 60 which tapers toward the exit port 40.

In use, a supply of air is conveyed into the nozzle 34 and travels along the inlet duct 38 towards the outlet port 40. During this time, the air passes into the constriction 42 and, thence, over the bevel 60 into the two part-ducts 50, 52 defined by the rib 46. Thereafter, the air passes out of the port 40 directly from the part-ducts 48, 50. Because of the positioning of the rib 46 the large scale swirling of the air within the part-ducts 48,50 is prevented so that the air exits from the exit port 40 in the form of an air jet which consists of practically co-directional sub-flows.

Of note, the auxiliary blow nozzle may be constructed with two adjacent bores or ducts instead of a rib. Moroever, it may be made of two pieces. Further, the rib may extend at least partially into the exit port 40.

The invention thus provides an auxiliary blow nozzle for a weaving machine which is able to emit a coherent air jet with a minimum dispersion angle instead of an air jet which is whirled apart and which has a considerable dispersion angle as in previously known blow nozzles such as that described in French Pat. No. 2475586 (FIG. 1).

What is claimed is:

1. An auxiliary blow nozzle for a pneumatic weaving machine, said nozzle having an inlet duct for conveying a flow of air longitudinally thereof, an exit port disposed at an end zone of said inlet duct and at an angle to said inlet duct; and at least one flat rib extending parallel to said duct in said end zone and adjacent said exit port.

2. An auxiliary blow nozzle as set forth in claim 1 wherein said rib extends substantially to an opposite wall of said inlet duct.

3. An auxiliary blow nozzle as set forth in claim 1 wherein said inlet duct has a base opposite said rib and inclined to a central longitudinal plane of said rib.

4. An auxiliary blow nozzle as set forth in claim 1 wherein said end zone surrounds said rib to form a pair of part-ducts of different cross-sectional shape.

5. An auxiliary blow nozzle as set forth in claim 1 wherein said rib has a pair of flanks, each flank being inclined to a central longitudinal plane of said rib and at an angle different from the other flank.

6. An auxiliary blow nozzle as set forth in claim 1 wherein said exit port has a length larger than the radius thereof.

7. An auxiliary blow nozzle as set forth in claim 1 wherein said exit port has a rounded edge adjacent said rib.

8. An auxiliary blow nozzles as set forth in claim 1 further having a substantially triangular bevel in said end zone of said inlet duct tapering towards said exit port.

9. An auxiliary blow nozzle for a pneumatic weaving machine, said nozzle comprising an elongated body;

an inlet duct within said body for conveying a flow of air along a longitudinal axis of said body;

an exit port in said body and communicating with an end zone of said inlet duct for exhausting a coherent air jet therefrom, said port being disposed on an axis angularly disposed to said longitudinal axis; and at least one elongated rib on said body within said end zone of said inlet duct and opposite said exit port, said rib extending parallel to said longitudinal axis for preventing a swirling of air in said end zone whereby the air jet consists of practically co-directional sub-flows.

10. An auxiliary nozzle as set forth in claim 9 wherein said rib divides said end zone into a pair of part-ducts of different cross-sectional shape from each other.

11. An auxiliary nozzle as set forth in claim 9 wherein said inlet duct has a base in said end zone opposite said rib and disposed in a plane inclined to a central longitudinal plane of said rib.

12. An auxiliary nozzle as set forth in claim 11 wherein said exit port extends from said base and has a circular opening, said exit port having a maximum length greater than the radius of said circular opening.

13. An auxiliary blow nozzle for a pneumatic weaving machine, said nozzle comprising an elongated body;

an inlet duct within said body for conveying a flow of air along a longitudinal axis of said body;

an exit port in said body and communicating with an end zone of said inlet duct for exhausting a coherent air jet therefrom, said port being disposed on an axis angularly disposed to said longitudinal axis; and a pair of adjacent ducts within said end zone of said inlet duct and opposite said exit port to conduct a flow of air to said exit port while preventing a swirling of air in said end zone whereby the air jet consists of practically co-directional sub-flows.

14. An auxiliary nozzle as set forth in claim 13 wherein said pair of ducts are of different cross-sectional shape from each other.

* * * * *

UNITED STATES PATENT AND TRADEMARK OFFICE

CERTIFICATE OF CORRECTION

PATENT NO. : 4,585,038

DATED : April 29, 1986

INVENTOR(S) : CHARLES KNISELY

It is certified that error appears in the above-identified patent and that said Letters Patent is hereby corrected as shown below:

Column 4, line 11 "nozzles" should be -nozzle-

Signed and Sealed this

Fourteenth Day of October, 1986

[SEAL]

*Attest:*

DONALD J. QUIGG

*Attesting Officer*

*Commissioner of Patents and Trademarks*